US006722848B1

(12) United States Patent
Couture et al.

(10) Patent No.: US 6,722,848 B1
(45) Date of Patent: Apr. 20, 2004

(54) TURBINE NOZZLE RETENTION APPARATUS AT THE CARRIER HORIZONTAL JOINT FACE

(75) Inventors: Bernard Arthur Couture, Schenectady, NY (US); David Orus Fitts, Ballston Spa, NY (US); Ronald Wayne Korzun, Clifton Park, NY (US); James David Schuhl, Charlton, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/284,211

(22) Filed: Oct. 31, 2002

(51) Int. Cl.[7] ..... F01D 9/04

(52) U.S. Cl. ..... 415/209.2; 415/210.1; 29/889.22

(58) Field of Search ..... 415/189, 190, 415/209.2, 209.3, 209.4, 210.1; 29/889.22

(56) References Cited

U.S. PATENT DOCUMENTS

| | | | | |
|---|---|---|---|---|
| 905,437 A | * | 12/1908 | Karlin | 415/190 |
| 5,259,727 A | * | 11/1993 | Quinn | 415/190 |
| 5,961,286 A | * | 10/1999 | Schaub et al. | 415/209.3 |
| 5,984,633 A | * | 11/1999 | Bachinger et al. | 415/209.2 |

* cited by examiner

*Primary Examiner*—Christopher Verdier
(74) *Attorney, Agent, or Firm*—Nixon & Vanderhye

(57) ABSTRACT

Nozzles for a turbine have dovetail-shaped bases for reception in corresponding dovetail-shaped grooves in the carrier halves of a turbine. The nozzles at each of the horizontal joint faces of each carrier half have notches formed along their bases including an abutment face. Key slots are formed in the horizontal joint faces and receive keys bearing against the abutment faces. The keys are peened or screwed into the carrier half at the horizontal joint faces. Radial loading pins engage the end nozzle bases to bias the end nozzles radially inwardly without interfering with the keys retaining the nozzles in the grooves.

17 Claims, 5 Drawing Sheets

TURBINE NOZZLE RETENTION APPARATUS AT THE CARRIER HORIZONTAL JOINT FACE

BACKGROUND OF THE INVENTION

The present invention relates to apparatus for retaining nozzles stacked one against the other in a groove of a carrier of a turbine and particularly relates to a turbine nozzle retention apparatus for retaining the nozzles in carrier grooves at the horizontal joint faces between upper and lower carrier halves which does not interfere with radially loading the nozzles.

In turbines, for example, steam turbines, there is provided a carrier for the axially spaced, circumferential arrays of nozzles. The carrier typically includes carrier halves which extend arcuately 180° and are secured to one another at a horizontal joint face to form a 360° array of nozzles at each axial stage position. While various techniques have been employed to retain the nozzles within the grooves of the carrier, typically the nozzles comprise an airfoil having a radial outer dovetail-shaped base for reception in a generally correspondingly dovetail-shaped groove in the carrier. Generally, the opposite side faces of each base of the nozzles are angled relative to the axis of the turbine enabling the base to accommodate the angularity of the airfoil. When the nozzles are installed in each carrier half groove, the nozzle bases are stacked one against the other within the grooves forming a semi-circular array of nozzles. The end nozzle at each horizontal joint face, prior to securing the carrier halves to one another, projects outwardly of the joint face. Radial loading pins are also provided for each nozzle. Each pin is disposed between the base of the nozzle and the base of the groove biasing the nozzle radially inwardly. A clearance between adjacent end nozzles across the horizontal joint of the upper and lower carrier halves is necessary when the carrier halves are secured to one another. Accordingly, there is a need for a retaining device at the horizontal joint face for retaining the nozzles within the carrier half groove and which does not interfere with the radial loading of the nozzles.

BRIEF DESCRIPTION OF THE INVENTION

In accordance with a preferred embodiment of the present invention, there is provided a turbine nozzle retention apparatus for retaining nozzles at the joint interface of each carrier half that does not interfere with but works in conjunction with the radial loading device, e.g., the radial loading pins. For example, each carrier half has a plurality of axially spaced grooves having semi-circular configurations about the carrier half. Each groove has a dovetail configuration. Nozzles having a correspondingly dovetail-shaped radially outer base are inserted into the carrier groove and stacked one against the other to form an arcuate array of nozzles. At each joint interface where a clearance between adjacent nozzles of the upper and lower carrier halves is required, each end nozzle projects beyond its associated joint face.

To retain the end nozzle in the horizontal joint face while accommodating a radial loading pin, the nozzle base of each end nozzle includes a notch formed along its radial outward face and which notch includes an abutment face extending in an axial direction. A key slot is formed in each carrier half at each joint face and lies in alignment with the notch and the abutment face. An elongated key is disposed in the notch in engagement against the abutment face of the nozzle base. A radial loading pin is disposed in a recess in the outermost wall of the carrier groove and engages the portion of the nozzle base which is not notched to provide the radial inward bias to the end nozzle. The key is secured to the carrier half and in the key slot at the joint face, for example, by peening between the joint face and the key. Alternatively, the key may be retained in the key slot by one or more screws having heads recessed below the joint interface. The key therefore prevents circumferential movement of the nozzle from the carrier groove while the radial loading pin biases the nozzle radially inwardly. It will be appreciated that the end nozzle and retainer key of the present invention is provided at at least one of two horizontal joint faces for each groove of each carrier half. Preferably, all four horizontal joint faces of the two carrier halves forming each annular groove of the carrier are provided with the nozzle retention apparatus hereof.

In a preferred embodiment according to the present invention, there is provided nozzle retention apparatus for a turbine comprising a generally semi-cylindrical nozzle carrier half for extending about an axis of the turbine and having an arcuate, radially inwardly opening, shaped groove terminating at opposite ends in respective joint faces, a plurality of nozzles for the turbine, each nozzle including an airfoil and an outer base having a shape generally corresponding to the shape of the groove and received in the groove, a key slot in one of the horizontal joint faces at one end of the groove, one of the nozzles in the groove of the carrier half at the one horizontal joint face extending circumferentially beyond the joint face and having a notch formed in the base thereof extending inwardly of the one joint face and a key in the key slot secured to the carrier half and engaging in the notch of the one nozzle to retain the nozzles in the carrier half groove.

In a further preferred embodiment according to the present invention, there is provided nozzle retention apparatus for a turbine comprising a generally semi-cylindrical nozzle carrier half for extending about an axis of the turbine and having an arcuate, radially inwardly opening dovetail-shaped groove terminating at opposite ends in respective joint faces, a plurality of nozzles for the turbine, each nozzle including an airfoil and an outer base having a dovetail shape generally corresponding to the dovetail shape of the groove and received in the dovetail-shaped groove, a key slot in one of the horizontal joint faces at one end of the groove, one of the nozzles in the groove of the carrier half at the one horizontal joint face having a notch formed in the base inwardly of the one joint face, a key in the key slot secured to the carrier half and engaging in the notch of the one nozzle to retain the nozzles in the carrier half groove and a pin engaging the one nozzle to bias the one nozzle in a radial inward direction and extending between the key and a radially inwardly facing surface along a base of the groove.

DETAILED DESCRIPTION OF THE INVENTION

Figure 1:
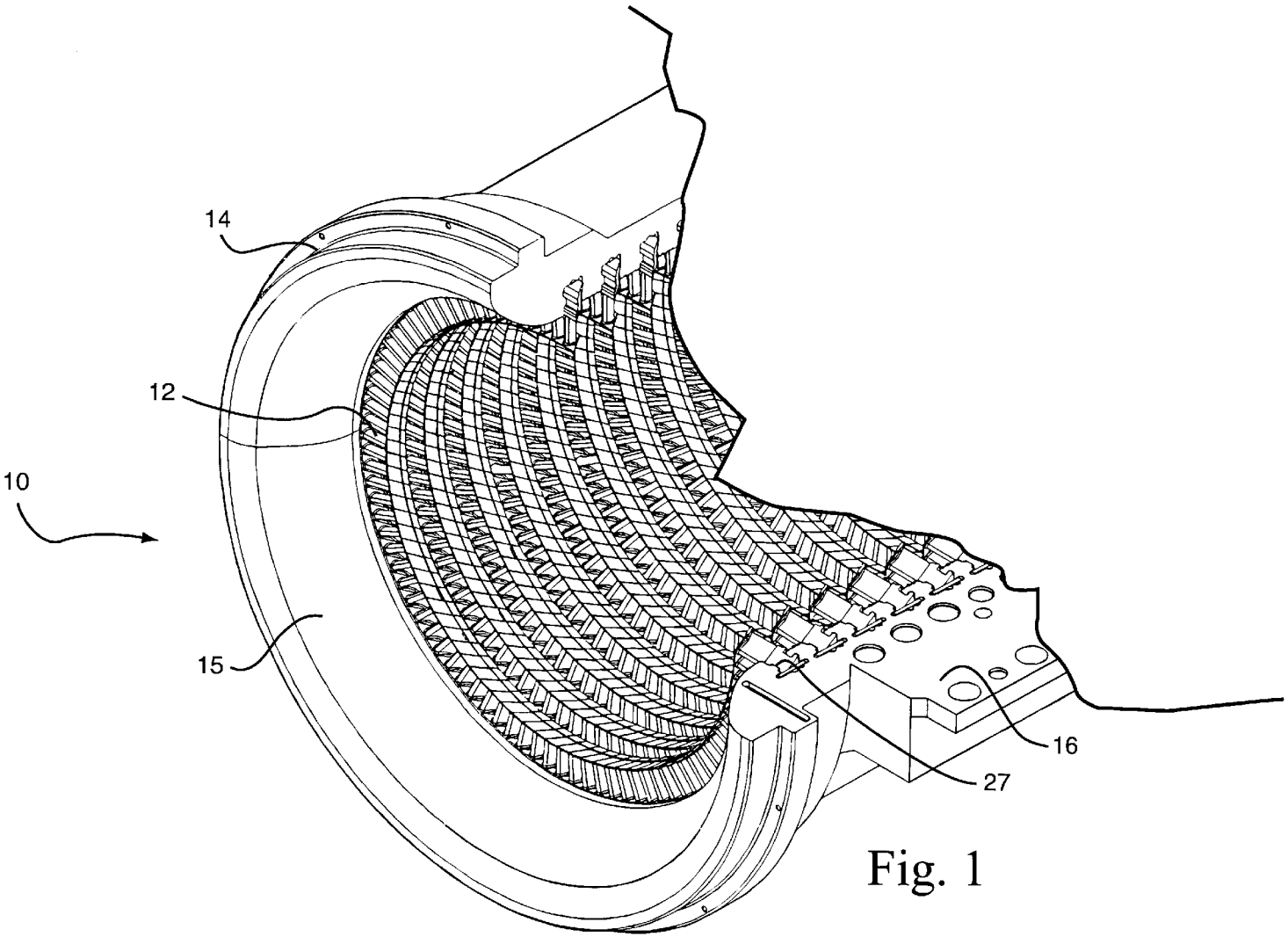
FIG. 1 is a fragmentary perspective view of a carrier illustrating axially spaced carrier grooves for a turbine and illustrated with the nozzles stacked in the grooves.

Referring now to the drawings, particularly to FIG. 1, there is illustrated a carrier, generally designated 10, for the nozzles 12 of a turbine, for example, a steam turbine. The carrier 10 includes upper and lower carrier halves 14 and 15, respectively, which are joined one with the other along a horizontal joint face 16. As illustrated, nozzles 12 are arranged in an annular array thereof at axially spaced locations along the carrier 10. Each array of nozzles 12 includes a plurality of discrete nozzles 12 stacked one against the other. When a rotor, not shown, is disposed within the lower carrier half and the carrier halves 14 and 15 are secured one to the other at the joint interface 16, the nozzles 12, together with airfoils or buckets on the rotor, form multiple stages of a turbine.

Figure 2:
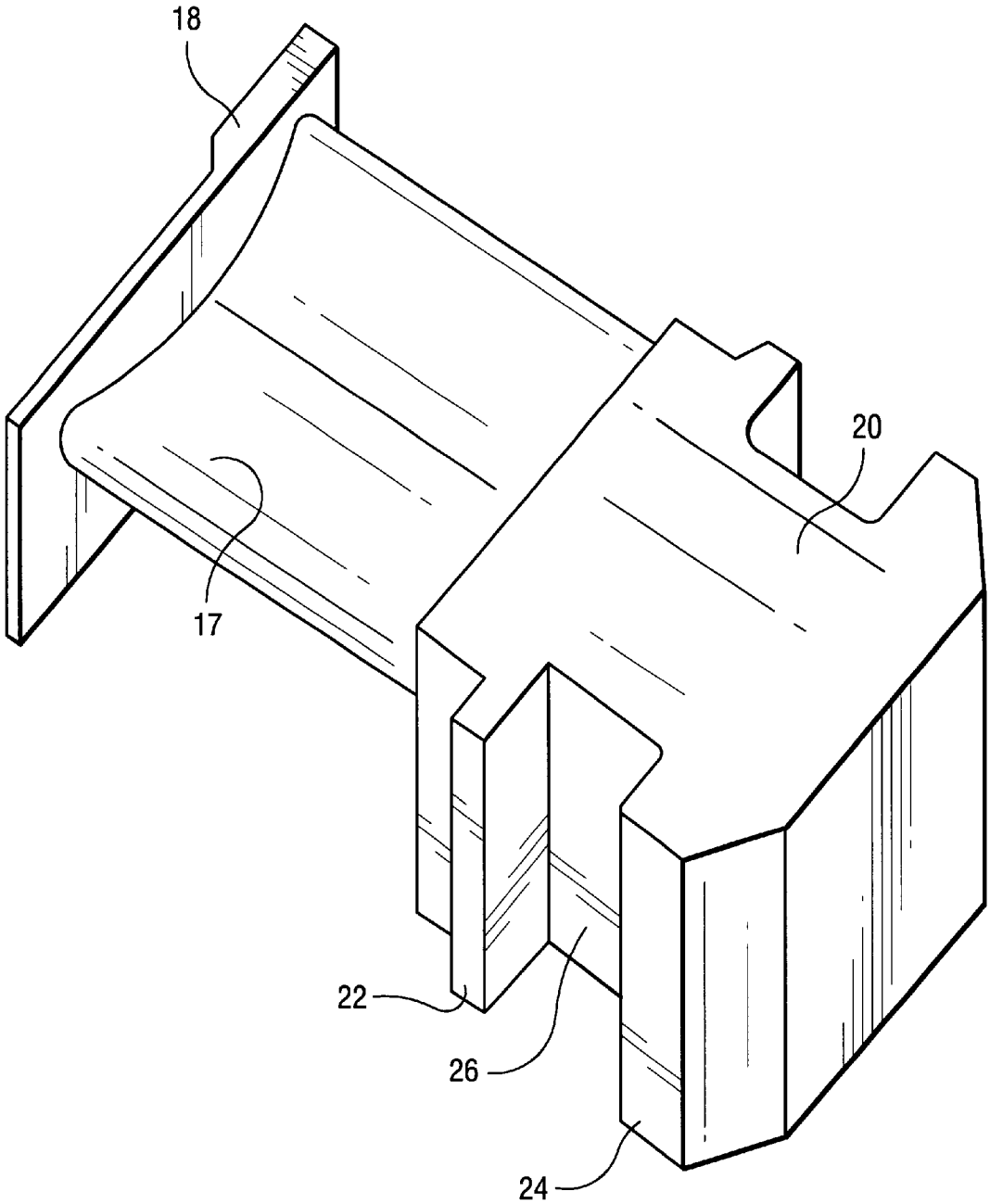
FIG. 2 is a perspective view of a representative nozzle disposed within the carrier grooves between end nozzles at the joint interfaces.
Figure 4:
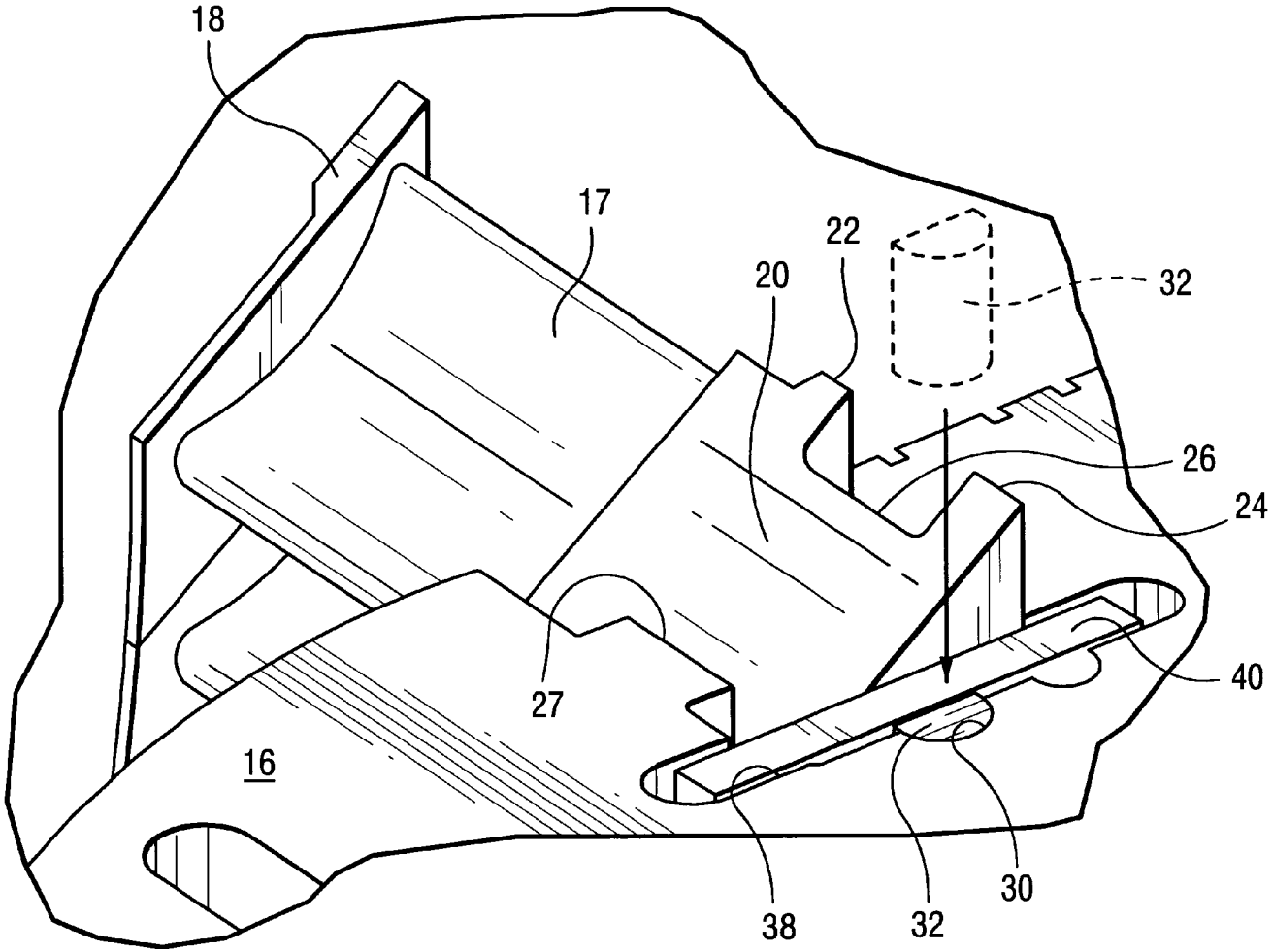
FIG. 4 is a view similar to FIG. 3 illustrating the nozzle at the horizontal joint face with a radial loading pin inserted.

As illustrated in FIG. 2, each nozzle includes an airfoil 17 including an inner band 18 and a base 20 having a dovetail configuration. Each base 20 has opposite sides parallel to one another and, when disposed in the carrier grooves, the opposite sides are angled relative to the axis of rotation of the turbine. In the illustrated form of the dovetail-shaped base of each nozzle, there is provided a pair of flanges 22 and 24 projecting in both axially upstream and downstream directions defining recesses 26 therebetween. The upper and lower carrier sections 14 and 15, respectively, are provided with generally correspondingly-shaped grooves 27 as the bases of the nozzles 12. The radial outward base of each groove also has a radial outward annular recess 30 (FIG. 4).

Figure 3:
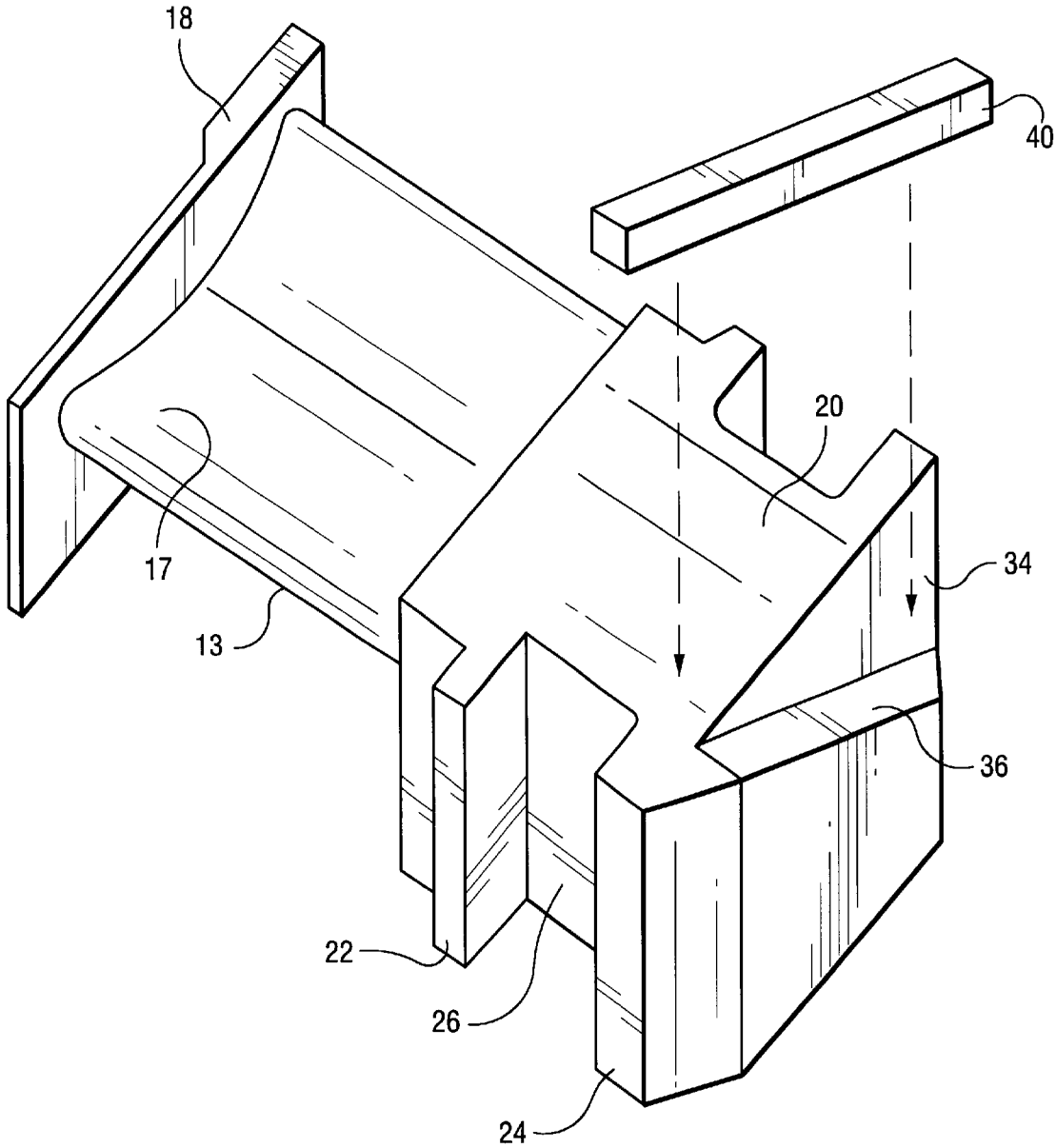
FIG. 3 is a perspective view of an end nozzle and a key for retaining the nozzle at a carrier joint face.

Typically, the nozzles 12 are stacked in the grooves one against the other in each of the upper and lower carrier halves 14 and 15, respectively. By setting a first or end nozzle at one of the horizontal joint faces, the remaining nozzles of the carrier section may be inserted by locating the dovetail-shaped bases 20 of succeeding nozzles in the opposite end of the groove 27 and sliding the nozzles into abutment one with the other until the groove 27 is entirely filled. As the nozzles are inserted, radial biasing pins 32 are inserted into the carrier groove from the opposite end of groove 27. The pins 32 engage between the radial outer base of the groove 27 and the radial outer faces of the bases 20 of the nozzles 12 to bias the nozzles 12 radially inwardly. The pins 32 have a flat face on one side for engaging the nozzle base 20 and are inserted from the opposite end of the carrier groove 27 from the nozzles being inserted into the groove. Once the nozzles are stacked in the groove, the final or end nozzle 13 (FIG. 3) for each carrier section at the horizontal joint face 16 is specifically configured for securement at the horizontal joint, as well as to avoid interference with and facilitate radial loading of the end nozzle 13 in a radial inward direction.

Preferably, end nozzles 13, as described herein, are provided at each of the opposite ends of each groove 27 of a carrier half. It will be appreciated, however, that such end nozzle 13 and the following described retention apparatus may be provided only at one end of each groove of each carrier half with the opposite end being otherwise secured. To accomplish the foregoing, and referring to FIG. 3, the end nozzles 13 for each of the carrier halves 14 and 15 are provided with a notch 34 along the radial outer face of the base 20 of the nozzle 12. The notch 34 includes an abutment face 36 which is formed generally parallel to the axis of rotation of the turbine. Thus, the notch 34 is essentially wedge-shaped as illustrated. When the end nozzles 13 are disposed in the grooves 27 at the joint faces, the abutment faces 36 lie below the horizontal joint faces 16 and a portion of each nozzle base 20 projects above the correspondingly horizontal joint face 16. The end nozzle 13 at the opposite end of each carrier groove 27 preferably has a similar arrangement with, however, the notch and the abutment face being formed on the opposite side of the end nozzle. That is, left and right hand end nozzles 13 are provided with the notches 34 and abutment faces 36 formed on respective opposite sides of their bases.

Prior to assembly of the nozzles 12 and 13 into the carrier shell grooves 27, a key slot 38 is formed in the horizontal joint face 16, preferably at the end of each groove. The key slot 38 extends in an axial direction forward and aft of the extent of the nozzle bases 20. Key slot 38 has a depth from the horizontal joint face 16 at least equal to the depth of the abutment face 36 from the joint faces when the end nozzle 13 is located at the horizontal joint face. As illustrated in FIG. 4, a key 40 is disposed in the key slot 38. The key 40 comprises an elongated rectilinear locking element which seats in the key slot 38 and bears against the abutment face 36 of the end nozzle base 20.

Figure 6:
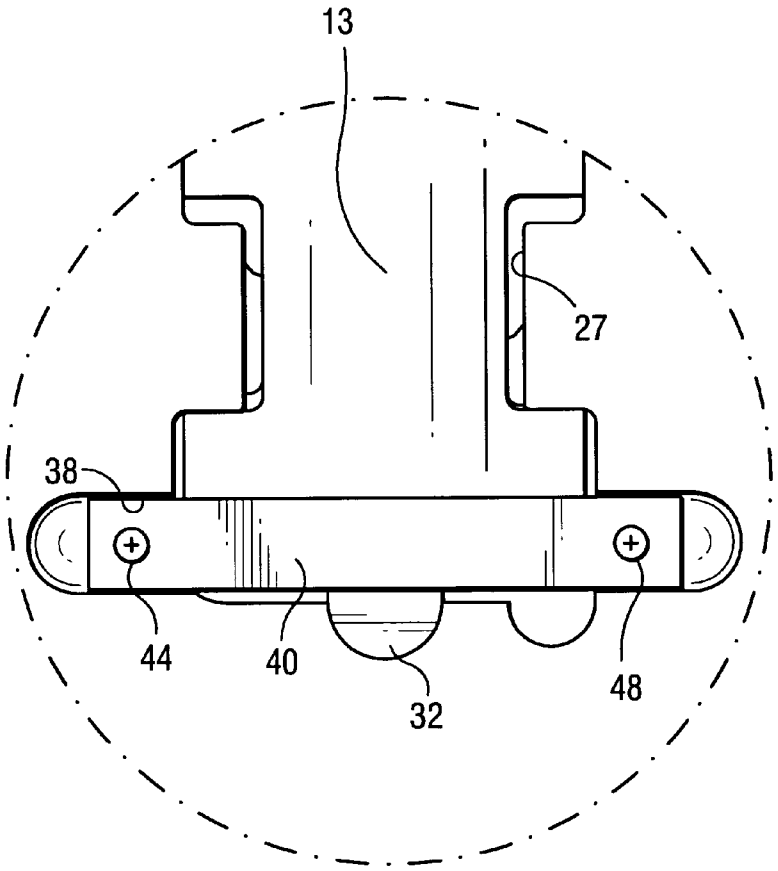
FIG. 6 is a view similar to FIG. 5 illustrating retention of the key in the slot by screws.
Figure 5:
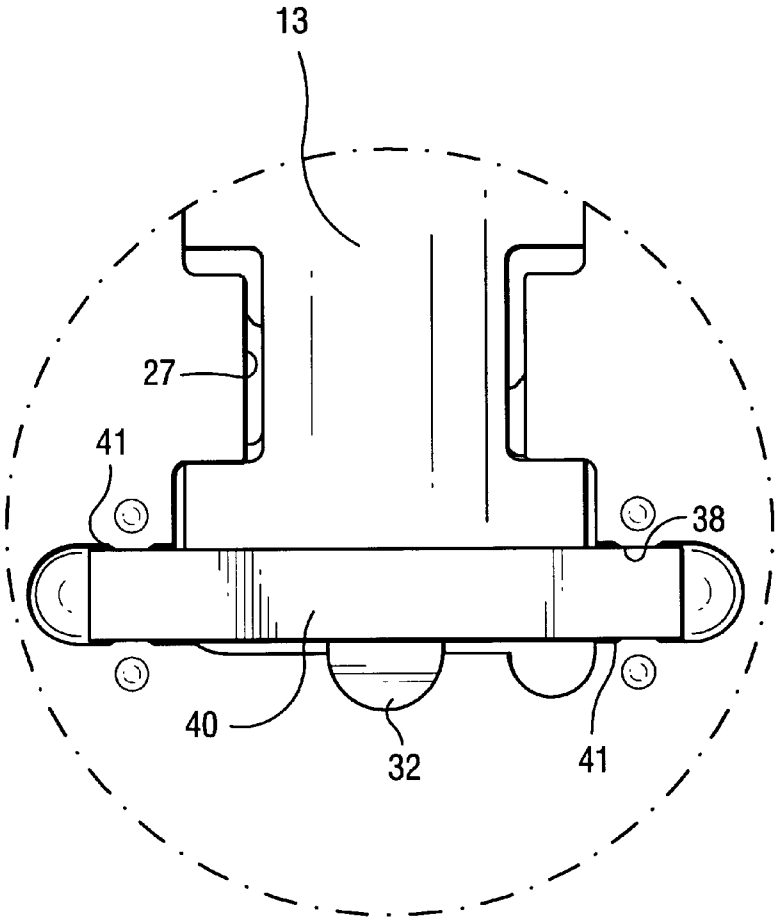
FIG. 5 is an enlarged fragmentary view at the joint face illustrating the key in the key slot peened to the carrier shell.

As illustrated in FIG. 5, key 40 is secured in the key slot 38, for example, by peening 41 adjacent opposite ends of the key 40. That is, the metal of the key 40 and portions of the adjoining joint face 16 is deformed to interfere with one another and thereby secure the key in the key slot with the key butting the abutment face 36, retaining the stacked nozzles 12 and 13 in the carrier half from displacement from the grooves. The key 40 may also be secured in the key slot 38 and to the carrier half by means other than peening. For example, and as illustrated in FIG. 6, the key 40 may have bore holes for receiving screws 44 threadedly received in the base of the key slot 38 and in the carrier half.

To radially load each end nozzle 13, the final radial load pin 32 is disposed between the base of the groove and bears against the base of the end nozzle 13 to bias the end nozzle radially inwardly, similarly as the other stacked nozzles in the carrier groove. Thus, the radial loading pin 32 at the end joint interface does not interfere with the key 40 and key slot 38 arrangement securing the nozzles in the carrier grooves.

It will be appreciated that the key 40 and radial pins 32 as well as the means for securing the key in the slot and preventing displacement of the nozzles from the grooves in a circumferential direction are all flush with or slightly recessed below the joint face 16. This is significant in order to secure the joint faces of the upper and lower carrier halves to one another with appropriate sealing, not shown, and with the appropriate clearance between the adjoining end nozzles at each of the joint faces.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Nozzle retention apparatus for a turbine comprising:

a generally semi-cylindrical nozzle carrier half for extending about an axis of the turbine and having an arcuate, radially inwardly opening, shaped groove terminating at opposite ends in respective joint faces;

a plurality of nozzles for the turbine, each nozzle including an airfoil and an outer base having a shape generally corresponding to the shape of the groove and received in the groove;

a key slot in one of said horizontal joint faces at one end of said groove;

the outer base of one of said nozzles in said groove of said carrier half at said one horizontal joint face extending circumferentially beyond said joint face and having a notch formed therein extending inwardly of said one joint face; and a key in said key slot secured to said carrier half and engaging in said notch of said outer base of said one nozzle to retain the nozzles in the carrier half groove.

2. Apparatus according to claim 1 including a member engaging the one nozzle to bias the one nozzle in a radial inward direction.

3. Apparatus according to claim 2 wherein said radial biasing member includes a pin and said carrier half groove includes a circumferentially extending recess along an outer surface of said carrier half groove for receiving the pin and biasing the one nozzle radially inwardly.

4. Apparatus according to claim 1 including a member engaging the one nozzle to bias the one nozzle in a radial inward direction, said member extending between said key and a radially inwardly facing surface along a base of said groove.

5. Apparatus according to claim 1 wherein said groove of said carrier half has a dovetail shape and the bases of the nozzles have a generally complementary dovetail shape.

6. Apparatus according to claim 1 including a second key slot in another of said horizontal joint faces at an opposite end of said groove, a second nozzle of said plurality of nozzles in said carrier half at said opposite end of said groove extending circumferentially through said another joint face and having a notch formed in the base thereof extending inwardly of said opposite joint face and a second key in said second key slot secured to said carrier half and engaging in said notch of said second nozzle to retain the nozzles in the carrier groove.

7. Apparatus according to claim 6 including a second member engaging said second nozzle to bias said second nozzle in a radial inward direction.

8. Nozzle retention apparatus for a turbine comprising:

a generally semi-cylindrical nozzle carrier half for extending about an axis of the turbine and having an arcuate, radially inwardly opening, shaped groove terminating at opposite ends in respective joint faces;

a plurality of nozzles for the turbine, each nozzle including an airfoil and an outer base having a shape generally corresponding to the shape of the groove and received in the groove;

a key slot in one of said horizontal joint faces at one end of said groove;

one of said nozzles in said groove of said carrier half at said one horizontal joint face extending circumferentially beyond said joint face and having a notch formed in the base thereof extending inwardly of said one joint face; and a key in said key slot secured to said carrier half and engaging in said notch of said one nozzle to retain the nozzles in the carrier half groove, a member engaging the one nozzle to bias the one nozzle in a radial inward direction, said member extending between said key and a radially inwardly facing surface along a base of said groove, and said member including a pin and said carrier half groove includes a circumferentially extending recess along said inwardly facing surface of said groove.

9. Nozzle retention apparatus for a turbine comprising:

a generally semi-cylindrical nozzle carrier half for extending about an axis of the turbine and having an arcuate, radially inwardly opening, shaped groove terminating at opposite ends in respective joint faces;

a plurality of nozzles for the turbine, each nozzle including an airfoil and an outer base having a shape generally corresponding to the shape of the groove and received in the groove;

a key slot in one of said horizontal joint faces at one end of said groove;

one of said nozzles in said groove of said carrier half at said one horizontal joint face extending circumferentially beyond said joint face and having a notch formed in the base thereof extending inwardly of said one joint face;

a key in said key slot secured to said carrier half and engaging in said notch of said one nozzle to retain the nozzles in the carrier half groove, and means for securing said key to said carrier half at the joint face.

10. Nozzle retention apparatus for a turbine comprising:

a generally semi-cylindrical nozzle carrier half for extending about an axis of the turbine and having an arcuate, radially inwardly opening, shaped groove terminating at opposite ends in respective joint faces;

a plurality of nozzles for the turbine, each nozzle including an airfoil and an outer base having a shape generally corresponding to the shape of the groove and received in the groove;

a key slot in one of said horizontal joint faces at one end of said groove;

one of said nozzles in said groove of said carrier half at said one horizontal joint face extending circumferentially beyond said joint face and having a notch formed in the base thereof extending inwardly of said one joint face; and a key in said key slot secured to said carrier half and engaging in said notch of said one nozzle to retain the nozzles in the carrier half groove;

said key and said carrier half being peened to one another at the joint face.

11. Nozzle retention apparatus for a turbine comprising:

a generally semi-cylindrical nozzle carrier half for extending about an axis of the turbine and having an arcuate, radially inwardly opening, shaped groove terminating at opposite ends in respective joint faces;

a plurality of nozzles for the turbine, each nozzle including an airfoil and an outer base having a shape generally corresponding to the shape of the groove and received in the groove;

a key slot in one of said horizontal joint faces at one end of said groove;

one of said nozzles in said groove of said carrier half at said one horizontal joint face extending circumferentially beyond said joint face and having a notch formed in the base thereof extending inwardly of said one joint face; and a key in said key slot secured to said carrier half and engaging in said notch of said one nozzle to retain the nozzles in the carrier half groove;

said key and said carrier half being secured to one another by screws extending through said key and into said carrier half.

12. Nozzle retention apparatus for a turbine comprising:

a generally semi-cylindrical nozzle carrier half for extending about an axis of the turbine and having an arcuate, radially inwardly opening, shaped groove terminating at opposite ends in respective joint faces;

a plurality of nozzles for the turbine, each nozzle including an airfoil and an outer base having a shape generally corresponding to the shape of the groove and received in the groove;

a key slot in one of said horizontal joint faces at one end of said groove;

one of said nozzles in said groove of said carrier half at said one horizontal joint face extending circumferentially beyond said joint face and having a notch formed in the base thereof extending inwardly of said one joint face; and a key in said key slot secured to said carrier half and engaging in said notch of said one nozzle to retain the nozzles in the carrier half groove;

a second key slot in another of said horizontal joint faces at an opposite end of said groove, a second nozzle of said plurality of nozzles in said carrier half at said opposite end of said groove extending circumferentially through said another joint face and having a notch formed in the base thereof extending inwardly of said opposite joint face and a second key in said second key slot secured to said carrier half and engaging in said notch of said second nozzle to retain the nozzles in the carrier groove, a second member engaging said second nozzle to bias said second nozzle in a radial inward direction, and wherein said second radial biasing member includes a second pin and said carrier half groove includes a circumferentially extending recess along an outer surface of said carrier half groove for receiving the second pin and biasing the second nozzle radially inwardly.

13. Nozzle retention apparatus for a turbine comprising:

a generally semi-cylindrical nozzle carrier half for extending about an axis of the turbine and having an arcuate, radially inwardly opening dovetail-shaped groove terminating at opposite ends in respective joint faces;

a plurality of nozzles for the turbine, each nozzle including an airfoil and an outer base having a dovetail shape generally corresponding to the dovetail shape of the groove and received in the dovetail-shaped groove;

a key slot in one of said horizontal joint faces at one end of said groove;

one of said nozzles in said groove of said carrier half at said one horizontal joint face having a notch formed in said base extending circumferentially and radially inwardly of and exposed through said one joint face;

a key in said key slot secured to said carrier half and engaging in said notch of said one nozzle to retain the nozzles in the carrier half groove; and a pin engaging the one nozzle to bias the one nozzle in a radial inward direction and extending between said key and a radially inwardly facing surface along a base of said groove.

14. Apparatus according to claim 13 including a second key slot in another of said horizontal joint faces at an opposite end of said groove, a second nozzle of said plurality of nozzles in said carrier half at said opposite end of said groove extending circumferentially through said another joint face and having a notch formed in the base thereof extending inwardly of said opposite joint face and a second key in said second key slot secured to said carrier half and engaging in said notch of said second nozzle to retain the nozzles in the carrier groove and a pin engaging said second nozzle to bias said second nozzle in a radially inward direction and extending between said second key and said radially inwardly extending surface of said groove.

15. Nozzle retention apparatus for a turbine comprising:

a generally semi-cylindrical nozzle carrier half for extending about an axis of the turbine and having an arcuate, radially inwardly opening dovetail-shaped groove terminating at opposite ends in respective joint faces;

a plurality of nozzles for the turbine, each nozzle including an airfoil and an outer base having a dovetail shape generally corresponding to the dovetail shape of the groove and received in the dovetail-shaped groove;

a key slot in one of said horizontal joint faces at one end of said groove;

one of said nozzles in said groove of said carrier half at said one horizontal joint face having a notch formed in said base inwardly of said one joint face;

a key in said key slot secured to said carrier half and engaging in said notch of said one nozzle to retain the nozzles in the carrier half groove;

a pin engaging the one nozzle to bias the one nozzle in a radial inward direction and extending between said key and a radially inwardly facing surface along a base of said groove; and means for securing said key to said carrier half at the joint face.

16. Nozzle retention apparatus for a turbine comprising:

a generally semi-cylindrical nozzle carrier half for extending about an axis of the turbine and having an arcuate, radially inwardly opening dovetail-shaped groove terminating at opposite ends in respective joint faces;

a plurality of nozzles for the turbine, each nozzle including an airfoil and an outer base having a dovetail shape generally corresponding to the dovetail shape of the groove and received in the dovetail-shaped groove;

a key slot in one of said horizontal joint faces at one end of said groove;

one of said nozzles in said groove of said carrier half at said one horizontal joint face having a notch formed in said base inwardly of said one joint face;

a key in said key slot secured to said carrier half and engaging in said notch of said one nozzle to retain the nozzles in the carrier half groove; and a pin engaging the one nozzle to bias the one nozzle in a radial inward direction and extending between said key and a radially inwardly facing surface along a base of said groove, said key and said carrier half being peened to one another at the joint face.

17. Nozzle retention apparatus for a turbine comprising:

a generally semi-cylindrical nozzle carrier half for extending about an axis of the turbine and having an arcuate, radially inwardly opening dovetail-shaped groove terminating at opposite ends in respective joint faces;

a Plurality of nozzles for the turbine, each nozzle including an airfoil and an outer base having a dovetail shape generally corresponding to the dovetail shape of the groove and received in the dovetail-shaped groove;

a key slot in one of said horizontal joint faces at one end of said groove;

one of said nozzles in said groove of said carrier half at said one horizontal joint face having a notch formed in said base inwardly of said one joint face;

a key in said key slot secured to said carrier half and engaging in said notch of said one nozzle to retain the nozzles in the carrier half groove; and a pin engaging the one nozzle to bias the one nozzle in a radial inward direction and extending between said key and a radially inwardly facing surface along a base of said groove; said key and said carrier half being secured to one another by screws extending through said key and into said carrier half.

* * * * *